US008998123B2

(12) United States Patent
de Jong et al.

(10) Patent No.: US 8,998,123 B2
(45) Date of Patent: Apr. 7, 2015

(54) DISPENSING DEVICE FOR LABELS

(71) Applicant: National Checking Company, St. Paul, MN (US)

(72) Inventors: Renee de Jong, Vlaardingen (NL); Dirk-Jan Notten, Neerpelt (BE); Frans U. A. van Waes, Tuil (NL)

(73) Assignee: National Checking Company, Saint Paul, MN (US)

( * ) Notice: Subject to any disclaimer, the term of this patent is extended or adjusted under 35 U.S.C. 154(b) by 291 days.

(21) Appl. No.: 13/631,507

(22) Filed: Sep. 28, 2012

(65) Prior Publication Data

US 2013/0075511 A1 Mar. 28, 2013

Related U.S. Application Data

(63) Continuation of application No. PCT/IB2011/001036, filed on Mar. 28, 2011.

(30) Foreign Application Priority Data

Mar. 29, 2010 (NL) ..... 2004465

(51) Int. Cl.
*B65H 75/18* (2006.01)
*B65H 16/00* (2006.01)
*B65C 11/00* (2006.01)

(52) U.S. Cl.
CPC ..... *B65H 16/005* (2013.01); *B65C 11/00* (2013.01)

(58) Field of Classification Search
USPC ..... 242/588, 588.3, 588.6, 615.3, 598.6; 221/70–74; 156/540, 541, 584
See application file for complete search history.

(56) References Cited

U.S. PATENT DOCUMENTS

| | | | | | |
|---|---|---|---|---|---|
| 1,892,544 | A | * | 12/1932 | Wanders | 242/588.6 |
| 2,373,092 | A | | 4/1945 | Avery | |
| 2,838,171 | A | | 6/1958 | Kaspar | |
| 2,912,140 | A | | 11/1959 | Cole | |
| 3,102,671 | A | | 9/1963 | Gershen | |
| 3,231,130 | A | | 1/1966 | Foote | |
| 3,283,886 | A | * | 11/1966 | Addis et al. | 242/588.6 |
| 3,698,600 | A | | 10/1972 | Foote | |
| 3,793,123 | A | | 2/1974 | Aronson | |
| 3,820,738 | A | * | 6/1974 | Collins | 242/343.2 |
| 4,108,390 | A | * | 8/1978 | Hayes | 242/588.6 |
| 4,330,357 | A | * | 5/1982 | Collins | 156/767 |
| 4,447,482 | A | * | 5/1984 | Heinzelman et al. | 428/42.3 |
| RE32,010 | E | * | 10/1985 | Collins | 156/527 |
| 4,590,089 | A | * | 5/1986 | Cartmell | 417/2 |
| 4,676,446 | A | * | 6/1987 | Ciocarelli et al. | 242/588.4 |
| 4,821,918 | A | | 4/1989 | Turner | |

(Continued)

*Primary Examiner* — William A Rivera
(74) *Attorney, Agent, or Firm* — Peacock Myers, P.C.; Janeen Vilven

(57) ABSTRACT

A dispensing device for adhesive labels, comprising a holder, a roll made from strip material comprising a carrier and adhesive labels adhered to the carrier. The holder made from plastic material and comprises adjacent holder sections connected with each other via at least one elastic hinge and joined on the opposite side by fixing means, such as 'click' fixing means. The holder forming a dispensing slot for the adhesive labels and an extended first curved guide for the strip material located between the roll and the dispensing slot. A second curved guide extends out next to the first curved guide. A transition point close to the dispensing slot between both curved guides such that the carrier is guided via both guides and the transition point in such a way that the transition point the adhesive labels are released from the carrier.

14 Claims, 4 Drawing Sheets

(56) References Cited

U.S. PATENT DOCUMENTS

| | | | | |
|---|---|---|---|---|
| 4,954,210 | A | 9/1990 | Desmond | |
| 4,967,929 | A | 11/1990 | Turner | |
| 5,378,301 | A * | 1/1995 | Boreali et al. | 156/719 |
| 5,570,809 | A | 11/1996 | Martin | |
| 5,806,714 | A * | 9/1998 | Geiger | 221/73 |
| 5,938,070 | A | 8/1999 | Welborn et al. | |
| 6,189,729 | B1 | 2/2001 | Keller | |
| 6,666,350 | B1 * | 12/2003 | Ludwig | 221/73 |
| 2003/0071051 | A1 | 4/2003 | Martinsen | |
| 2007/0210099 | A1 | 9/2007 | Van Waes et al. | |

* cited by examiner

DISPENSING DEVICE FOR LABELS

CROSS REFERENCE TO RELATED APPLICATIONS

This Application is a continuation application of the International Patent Application with Serial number PCT/IB2011/001036, entitled "Dispensing Device for Labels", to TTRC Training, Trading & Consultancy B.V., Tuil, Netherlands, filed on Mar. 28, 2011, which claims the benefit of Netherlands application NL2004465, entitled "Dispensing Device for Labels", filed Mar. 29, 2010, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHT MATERIAL

Not Applicable.

FIELD OF THE INVENTION

The invention relates to a dispensing device for adhesive labels, comprising of a holder and, contained within the holder, a roll made from strip material which comprises a carrier as well as adhesive labels adhered to the carrier, said holder being made from plastic material of uniform thickness and comprising adjacent holder sections that are connected with each other on one side via at least one elastic hinge and which are joined together on the opposite side by fixing means, such as 'click' fixing means, said holder parts together forming a dispensing slot for the adhesive labels as well as an extended first curved guide for the strip material which is located between the roll and the dispensing slot.

DESCRIPTION OF RELATED ART

Such a dispensing device is known from US-A-5358113. This known dispensing device is made from a transparent plastic and is produced from a flat sheet of plastic material of uniform thickness. The flat sheet is formed to the required shape in a jig by means of thermoforming. The ultimate holder for the dispensing device is obtained by folding the holder parts towards each other and securing the holder parts together. The holder contains a roll consisting of a carrier which is rolled up and has roll windings. The adhesive labels are applied to the spherically curved surfaces of the roll windings, in other words on the outside of each roll winding. The carrier, together with the adhesive labels, extends outwards, after which the adhesive labels have to be removed from the carrier by hand. The carrier can also be bent by hand from the dispensing slot. The aim of this being that the labels more or less free themselves from the carrier.

Removing the labels from the carrier in this way is troublesome and forms an extra operation that hinders the use of the known dispensing device. In theory it is known from Dutch patent specification 1028957 and from American patent specification 482918 that the carrier is guided via a curved section so that the labels more or less are released from the carrier. However, the dispensing device known from the Dutch patent specification 1028957 does not contain any curved guides for the strip material, as a result of which that material is not guided particularly well during unwinding and there is the risk that the labels are released from the carrier too early.

The American patent specification 4821918 relates to a holder with formed walls of variable wall thickness, for which a separate insert is also used to ensure the correct dispensing of the adhesive labels. Such a holder is relatively expensive.

Document U.S. Pat. No. 4,967,929 (A) recites a label dispenser and holder that includes a rectangular frame having a bottom support member, a top member, a pair of spaced apart end members, a back member, and a front member. At least two rectangular label dispensers are positioned within the holder. The holder includes various brackets which permit it to be universally mounted to various types of supporting surfaces, including a bracket for detachably securing the holder to a person's belt. The dispenser box includes a pair of spaced apart slits in the edge wall of the box. Either one or two guide members are provided within the box for guiding a label type having a backing strip and a label strip detachably adhered to one side of the backing strip. The guide members guide the label tape so that the labels are separated from the backing strip and are expelled from one of the two slots in the edge wall of the box.

The dispenser relates to a complicated structure, having various parts, being made out of different materials. Also the dispenser has only one guiding means 228 formed by parts, e.g. 208 and 206. As a consequence release or dispense of labels is not reliable.

Document U.S. Pat. No. 3,102,671 (A) recites a tape dispenser. However, the dispenser relates to a complicated structure, formed out of various parts being molded. Also various moldings are used. Furthermore, the dispenser has various thicknesses. The dispenser is not suited for dispensing stickers, labels and the like. It also comprises only one guiding means. Further it needs a cutter to release an adhesive. Therefore it does not need guiding means for releasing or dispensing.

U.S. Pat. No. 3,793,123 (A) recites a label dispenser which includes a hollow body having opposite spaced sides and a rear face and provided with an outlet opening. A substantially centrally disposed support extends across the sides and is adapted to support a roll of interconnected separable labels. The sides of the body each carry fasteners thereupon with the fasteners on one side of the body being complementary to the fasteners upon the opposite side of the body. The rear face of the body also carries fastening means.

BRIEF SUMMARY OF THE INVENTION

The object of the invention is therefore to provide a dispensing device of the type described above which can be produced relatively easily and economically and which also allows the labels to be released from the carrier themselves. That object is achieved because a second curved guide is provided which extends out next to the first curved guide because there is an transition point close to the dispensing slot between both curved guides and because the carrier is guided via both guides and the transition point in such a way that at the location of the transition point the adhesive labels are released from the carrier.

Amongst others, this dispensing device is more hygienic in use and complies with legislation such as HACCP. It is noted that not all state of the art dispensing devices comply with the legislation because labels not yet dispensed can, for example, become contaminated with bacteria. Furthermore, the dispensing device can be produced from a material that is recyclable. In addition, the dispensing device provides an extra guide so that labels are released from the carrier in a simple and reliable manner. New rolls of carrier and labels are also easy to fit into the dispensing device. The dispensing device is also easy to use, specifically in a kitchen or food preparation area. For example, it is possible to work in a much cleaner fashion with the labels. The risk of cross-contamination is also reduced to a minimum.

DETAILED DESCRIPTION OF THE INVENTION

According to the invention, both curved guides are obtained by folding the holder parts, which are formed from the flat sheet of plastic material. As a result of this a very even guide is obtained for the adhesive label carrier and there is therefore virtually no risk of the adhesive labels being released too early in the holder. They shall be released at the required position, in other words at the location of the transition point between both curved guides, which is also the location of the dispensing slot.

According to a simple design, both guides can have the same direction of curvature. In this design the guides can be arranged efficiently next to each other without taking up excessive space. Specifically, the first guide can be circumscribed by a first spherically curved wall so that the direction of curvature of the strip material being guided over or along that wall is opposite to the direction of curvature of the roll windings. Furthermore, the second guide can be circumscribed by a second spherically curved wall so that the direction of curvature of the carrier being guided over that second wall is the same direction of curvature of the roll windings. According to a simple type of design, both guides can be located on both sides of a curved dam wall.

At the location of the transition point between the first and the second curved wall the carrier has a relatively acute bend in a direction of curvature that is opposite to the direction of curvature of the roll windings. As a result of this direction of curvature, and the acute curvature, the adhesive labels then separate from the carrier so that they can be dispensed from the dispensing slot without further action. The second guide can open out to a discharge slot for the carrier where the carrier can be discharged and, for example, torn off.

As already stated above, the holder parts are fastened together on the away-facing ends of the elastic hinge. These fixing means can be formed in various ways. For example, the holder parts can be fastened together there using an adhesive or by using 'click' fixing means and the like. However, preferred is a type of design wherein the fixing means incorporate an auxiliary wall that extends cross-ways between both holder parts and which abuts the dispensing slot by means of a bevelled edge. This auxiliary wall can be fastened to one of the holder parts via an elastic hinge. The auxiliary wall can be fastened to the other holder part via 'click' fixing means for example; however, other methods of fixing such as bonding and suchlike are also possible.

On the side opposite the auxiliary wall the holder parts can each be fixed to the opposite sides of the auxiliary wall via an elastic hinge. All of the holder parts, the intermediate wall and the auxiliary wall can be produced from a single piece of flat sheet material of uniform thickness. Preferably the elastic hinges are orientated parallel to the centre line of the roll.

In relation to receiving the roll of strip material the holder parts can enclose a chamber which in essence is cylindrically-shaped and to which the first guide, which extends between the roll and the dispensing slot, is in essence tangentially connected. Via this tangential connection the strip material can be removed from the roll without any problems and transferred to the dispensing slot.

The holder parts can carry connectors on the away-facing surfaces which, combined, can be fitted with connectors to a holder part of another holder. A series of dispensing devices can thus be built as required.

For the dispensing device according to the invention the adhesive labels can be adhered to the concave curved surface of the roll windings. As a result of that position, the adhesive labels are well protected against external influences. This also applies at the stage when the roll is outside of the holder. This is also a benefit when the roll is being fitted into the holder because the labels are well protected against coming loose because they are not exposed to, for example, knocks or friction along the holder when being fitted. The stated position on the inside of the roll winding is specifically of benefit during the stage when the roll is in the holder. After all, when the labels are being dispensed the roll is unrolled in the holder. The carrier slides along the internal surfaces of the holder during dispensing. As a result of this the labels shall not slip from the carrier because they are not exposed to friction forces occurring during this.

The invention also relates to a holder for a dispensing device as described above. This holder is made of plastic material of uniform thickness and comprises adjacent holder parts that are connected with each other on one side via at least one elastic hinge and which on the opposite sides are connected by fixing means, such as 'click' fixing means, and said holder parts form a dispensing slot and together enclose a chamber for a roll of strip material, as well as an extending first curved guide for strip material which is located between the chamber and the dispensing slot.

The holder parts can carry connectors on their away-facing surfaces which, combined, can be fitted with connectors to a holder part of another holder. In this way several such holders can be set up adjacent to each other to form a single unit. Preferably the connectors are circular, in such a way that the circular connectors of one holder part of the holder lock around the circular connector of the other holder part of the adjacent holder. Such connectors can be used on each type of holder, in other words on all kind of different holders than the holder described above. To this end, the connectors can also contain recesses on both sides and protrusions in and on the ring which can click or press into each other.

According to the invention a second curved guide is provided which extends next to the first curved guide, while close to the dispensing slot there is a transition point between the curved guides around which the strip material can be guided.

The invention also relates to a flat sheet for the holder described above, comprising holder panels which are substantially in line with each other and connected via at least one elastic hinge. Preferably the flat sheet contains an intermediate panel on both sides of which the holder panels are fitted via elastic hinges. In addition, an auxiliary panel can be fixed to one of the holder panels, on the away-facing side of the intermediate panel, via an elastic hinge.

EXAMPLES

The invention shall now be detailed on the basis of an embodiment shown in the figures.

DETAILED DESCRIPTION OF THE DRAWINGS/FIGURES

Figure 1:
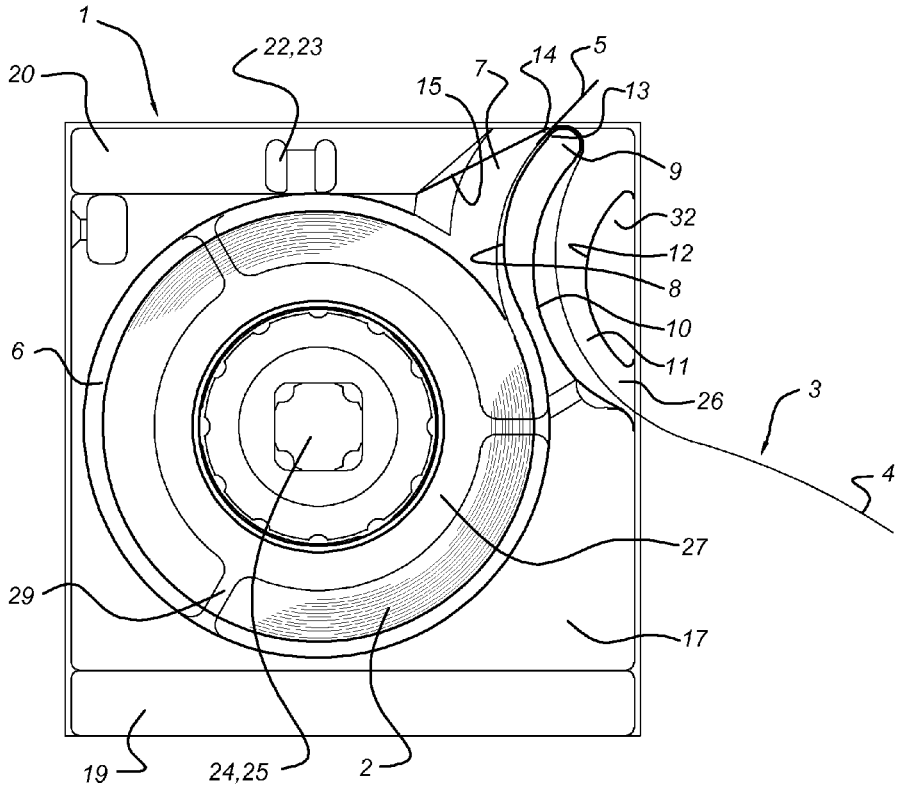
FIG. 1 shows a side view of the dispensing device according to the invention.
Figure 2:
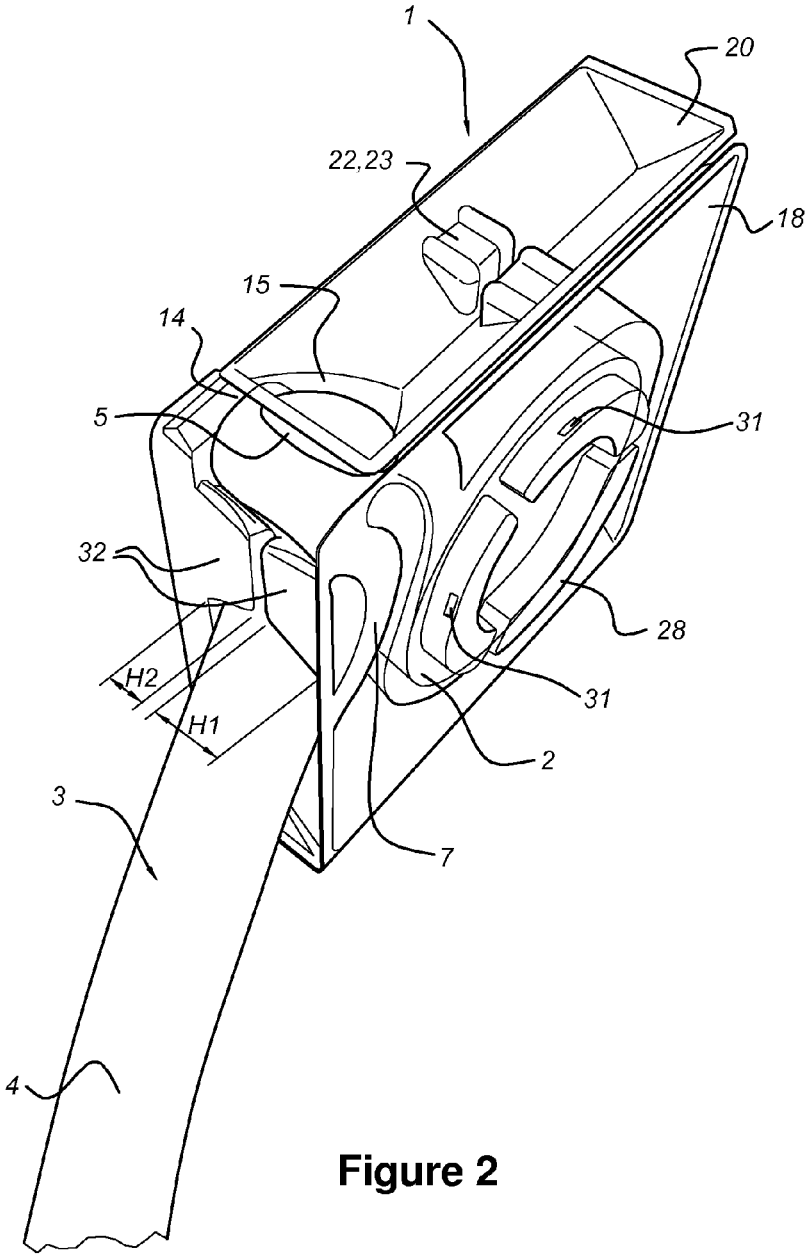
FIG. 2 shows a perspective view of the dispensing device according to the invention.

The dispensing device shown in FIGS. 1 and 2 consists of the holder 1 and the roll 2 that is incorporated in the holder. The roll contains a number of roll windings of strip material 3 that consist of the carrier 4 and the adhesive labels 5 that are adhered to the carrier 4. The holder has an internal chamber 6, to which the first curved guide 7 connects. Via this curved guide 7 the strip material 3 is removed from the roll 2. The first curved guide 7 is circumscribed by a first spherically curved wall 8. This spherically curved wall 8 forms one circumscription of dam wall 9, which on the other side is circumscribed by the concave curved wall 10 of a second curved guide 11. Opposite the concave curved wall 10, this second curved guide has a second spherically curved wall 12 of the second dam wall 32. The acute spherically curved transition point 13 between both guides 7, 11 is located close to the dispensing slot 14 for the adhesive labels 5. Opposite the spherically curved wall 12 there is a bevelled edge 15, which runs to the dispensing slot 14 and is formed in such a way that the adhesive labels 5 can reach the dispensing slot 14 untroubled without coming loose from the carrier 4 too early. Via the discharge slot 26 on the end of the second curved guide 11 it is possible to discharge the carrier 4 from which the adhesive labels have been removed.

Figure 3:
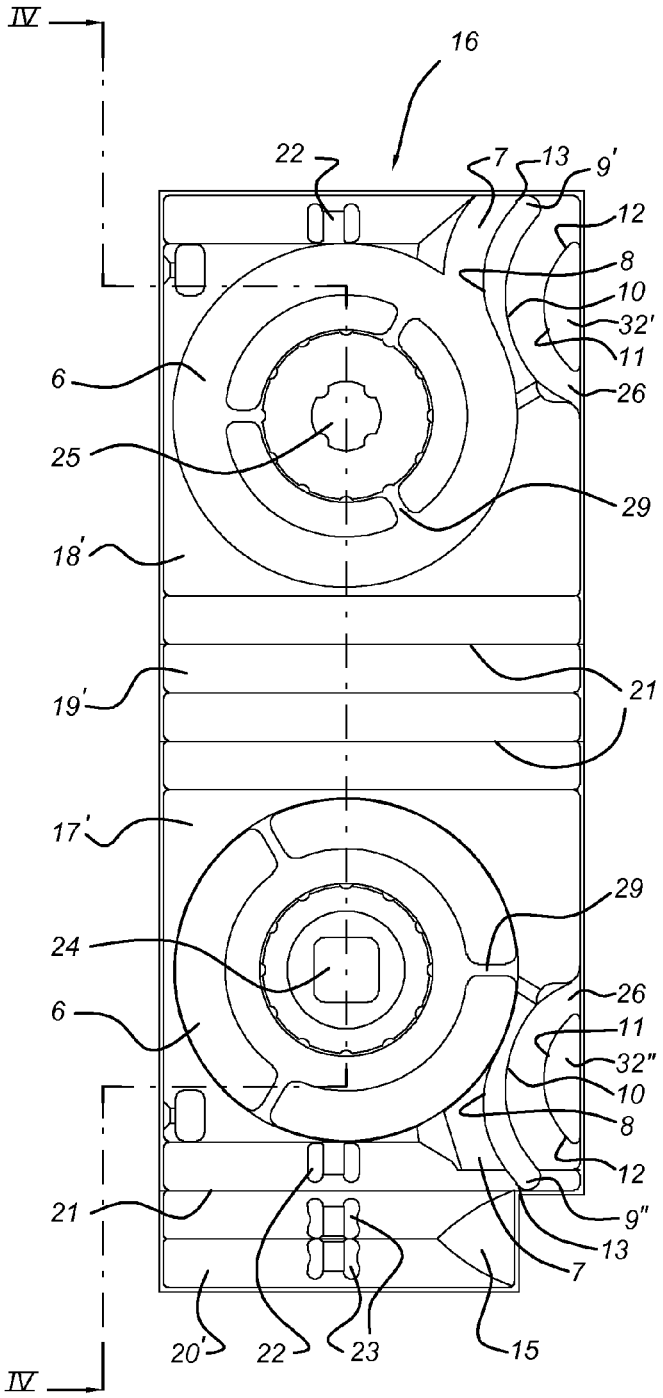
FIG. 3 shows a view of the flat sheet for the holder of the dispensing device according to FIGS. 1 and 2.
Figure 4:
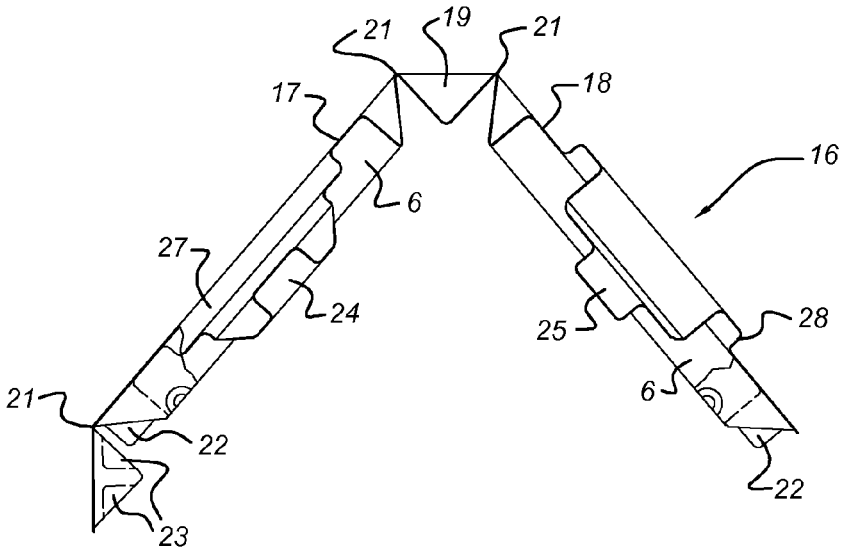
FIG. 4 shows a cross-section according to IV-IV of the flat sheet (in a slightly folded state) according to FIG. 3.

A shown in FIGS. 3 and 4, holder 1 is formed from a flat sheet 16. This flat sheet 16 consists of the two holder panels 17', 18', the intermediate panel 19' and the auxiliary panel 20' which, together, are connected by the elastic hinges 21 to form a single unit. These panels 17'- 20' are intended to form the holder parts 17, 18 respectively, the intermediate wall 19 and the auxiliary wall 20. The auxiliary wall 20 has a connecting part 23 which can combine, for example by 'clicking in' with connecting part 22 of holder part 18, in order to connect the auxiliary wall 20 with holder part 18. In addition, each of the holder parts 17, 18 have central connectors 24 or 25 which can likewise be 'clicked' into each other. These central fixing means are located in the centre of chamber 6, such that the roll 2 can be guided around them. It should be noted that the view in FIG. 3 shows the flat sheet in flat state, while the view in FIG. 4 shows the flat sheet in a slightly folded state.

Preferably this dispensing device has more than one connectors 22 and 23 provided, such as two or more. Amongst other things, this benefits the rigidity of the dispensing device. Preferably the more than one connecting parts 22, 23 are fitted in principle with two sides opposite each other, for example on a left and on a right side; in other words on a left and on a right side of a roll 2. Said construction is also easier to batch produce because, for example, there is less wastage.

Dam wall section 9 should preferably have a curvature with a radius greater than or equal to that of a full roll 2, preferably a curvature that is 1.5-3 times greater (1.5-3 times greater radius). It has thus been found in experiments that labels are released from the carrier even more reliably.

Preferably in this dispensing device the eye (no reference number) at the top left and bottom left is omitted.

As shown in FIG. 4 the height H1 of the dam wall sections 9', 32' of holder panel 18" is larger than the height H2 of dam wall sections 9", 32" of holder panel 17'. The ratio between the heights H1/H2 can be 3/2 for example, although other ratios are also possible. The purpose of this thickness difference between panels 17', 18' is to improve the insertion and guiding of the roll 2: the roll can be inserted into holder panel 18' better because the depth of the relief is larger there.

On the outside of holder parts 17, 18 connectors 27, 28 are fitted by means of which several holders 1 can be connected to each other. These connectors are circular with a different diameter such that the circular connectors 27 of holder part 17 are a push fit within circular connectors 28 of holder part 18. The circular connectors have recesses 29, such that there is a certain degree of flexibility of the circular connectors 28 and as a consequence a clasping action is facilitated. On both sides of the rings there can be protrusions 30 and/or recesses 31 in order to improve the clasping action of connectors 28 by 'clicking in'.

LIST OF REFERENCE SIGNS

1. Holder
2. Roll
3. Strip material
4. Carrier
5. Adhesive Label
6., 6.' Chamber
7., 7.' First curved guide
8., 8.' First convex curved wall
9., 9.', 9" Dam
10., 10.' Concave curved wall
11., 11.' Second curved guide
12., 12.' Second convex curved wall
13., 13.' Transition
14., 14.' Dispense opening
15. Bevelled edge
16. Flat Sheet
17., 17.' Holder part/-panel
18., 18.' Holder part/-panel
19., 19.' Intermediate wall/-panel
20., 20.' Auxiliary wall/-panel
21. Elastic hinge
22.-25. Connector parts
26. Discharge slot
27., 28 External connectors
29. Recess
30., 31. Click means
32.,32'.,32" Damm

What is claimed is:

1. Dispensing device for adhesive labels, comprising:

a holder as well as a roll, incorporated in the holder, the roll consisting of strip material which comprises a carrier as well as adhesive labels adhered to the carrier, said holder consisting of plastic material of uniform thickness and comprising adjacent holder parts that on one side are connected together via an elastic hinge on either side of an intermediate wall panel and said each of the adjacent holder parts are connectable together in the closed state on the opposite side by a snap fit construction, said holder parts together forming a dispensing slot for the adhesive labels as well as an extended first curved guide for the strip material which is located between the roll and the dispensing slot, wherein a second curved guide is provided which extends next to the first curved guide, that a transition point is located close to the dispensing slot between both curved guides, and that the carrier is guided via both guides and the transition point, such that at the location of the transition point the adhesive labels are released from the carrier.

2. Dispensing device according to claim 1, wherein the guides have the same direction of curvature, and/or wherein both guides are located on both sides of a curved dam wall.

3. Dispensing device according to claim 1, wherein the first guide is circumscribed by a first spherically curved wall such that the direction of curvature of the strip material guided over or along said wall is opposite to the direction of curvature of the roll windings, and/or wherein the second guide is circumscribed by a second spherically curved wall such that the direction of curvature of the carrier guided over that second wall is the same direction of curvature of the roll windings.

4. Dispensing device according to claim 1, wherein the second guide opens out into a discharge slot for the carrier.

5. Dispensing device according to claim 1, wherein the fixing means comprise an auxiliary wall that extends cross-ways between both holder parts and which abuts the dispensing slot by means of a bevelled edge, whereby the auxiliary wall is secured via an auxiliary wall elastic hinge to one of the holder parts and to the other holder part via the snap fit construction.

6. Dispensing device according claim 1, wherein the holder parts enclose a chamber which is substantially cylindrically shaped and which contains the roll, on which said chamber is substantially tangentially connected to the first curved guide which extends between the roll and the dispensing slot, and/or wherein the holder parts carry connectors on the away-facing surfaces of the holder parts which, combined, can be fitted with connectors to a holder part of another holder.

7. Dispensing device according to claim 6, wherein the chamber contains central connecting parts by means of which the holder parts are connected and around said connecting parts the roll is guided in a rotary manner.

8. Dispensing device according to claim 6, wherein the connectors are circular and the circular connectors of one holder part of the holder are a push fit around the circular connectors of the other holder part of an adjacent holder, wherein the circular connectors are preferably provided with recesses and protrusions to improve the clasping action by 'clicking in'.

9. Dispensing device according to claim 1, wherein each elastic hinge is parallel to the center line of the roll.

10. Dispensing device according to claim 1, wherein the adhesive labels are adhered to the concave curved surface of the roll windings.

11. Holder for a dispensing device comprising: plastic material of uniform thickness and comprising adjacent holder parts that are connected together on one side via at least one elastic hinge and which adjacent holder parts are connectable together on the other side by a snap, said adjacent holder parts forming a dispensing slot and mutually enclose a chamber for a roll of strip material, as well as a protruding first curved guide for strip material between the chamber and the dispensing slot, wherein a second curved guide is fitted which extends next to the first curved guide, and that there is a transition point close to the dispensing slot between both curved guides around which the strip material can be guided and wherein the snap fit construction comprises an auxiliary wall that extends cross-ways between adjacent holder parts and which abuts the dispensing slot by means of a bevelled edge, whereby the auxiliary wall is secured via an auxiliary wall elastic hinge to one of the holder parts and is connectable to the other holder part via the snap fit construction.

12. Flat sheet for the holder according to claim 11, comprising holder panels which are substantially in line with each other and connected via the at least one elastic hinge.

13. Flat sheet according to claim 12, wherein the heights H1, H2 of a relief of the holder panels differ from each other.

14. Dispensing device for adhesive labels, comprising a holder as well as a roll, incorporated in the holder, consisting of strip material which comprises a carrier as well as adhesive labels adhered to the carrier, said holder consisting of plastic material of uniform thickness and comprising adjacent holder parts that are connected together on one side via at least one elastic hinge and which are connected together on the opposite side by a snap fit construction, said holder parts together forming a dispensing slot for the adhesive labels as well as an extended first curved guide for the strip material which is located between the roll and the dispensing slot, wherein a second curved guide is provided which extends next to the first curved guide, that a transition point is located close to the dispensing slot between both curved guides, and that the carrier is guided via both guides and the transition point, such that at the location of the transition point the adhesive labels are released from the carrier and wherein the fixing means comprise an auxiliary wall that extends cross-ways between both holder parts and which abuts the dispensing slot by means of a bevelled edge, whereby the auxiliary wall is secured via an auxillary wall elastic hinge to one of the holder parts and to the other holder part via the snap fit construction.

* * * * *